US006949012B2

(12) United States Patent
Barnett, III

(10) Patent No.: US 6,949,012 B2
(45) Date of Patent: Sep. 27, 2005

(54) POLISHING PAD CONDITIONING METHOD AND APPARATUS

(75) Inventor: Herb Barnett, III, Longview, WA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/316,533

(22) Filed: Dec. 10, 2002

(65) Prior Publication Data

US 2004/0110453 A1 Jun. 10, 2004

(51) Int. Cl.[7] ..... B24B 1/00
(52) U.S. Cl. ..... 451/56; 451/548
(58) Field of Search ..... 451/56, 529, 527, 451/548, 550

(56) References Cited

U.S. PATENT DOCUMENTS 1,100,612 A * 6/1914 Pointon ..... 451/529
2,334,642 A * 11/1943 Moore ..... 451/488
2,952,951 A * 9/1960 Simpson et al. ..... 451/529
3,043,064 A * 7/1962 Peterson ..... 451/529
3,353,308 A * 11/1967 Riccardo ..... 451/529
4,037,367 A * 7/1977 Kruse ..... 451/551
5,197,249 A * 3/1993 Wiand ..... 451/529
5,243,790 A * 9/1993 Gagne ..... 451/528
6,196,911 B1 * 3/2001 Preston et al. ..... 451/548

* cited by examiner

*Primary Examiner*—Lee D. Wilson
(74) *Attorney, Agent, or Firm*—Schwabe, Williamson & Wyatt, P.C.

(57) ABSTRACT

A method and apparatus is provided that comprises an improved substrate polishing pad conditioning plate. In one embodiment, the conditioning plate contains multiple channels interposed between the abrasive surfaces so as to manage slurry and debris to resist clogging the abrasive surface of the conditioning plate so as to enable conditioning of the polishing pad.

20 Claims, 2 Drawing Sheets

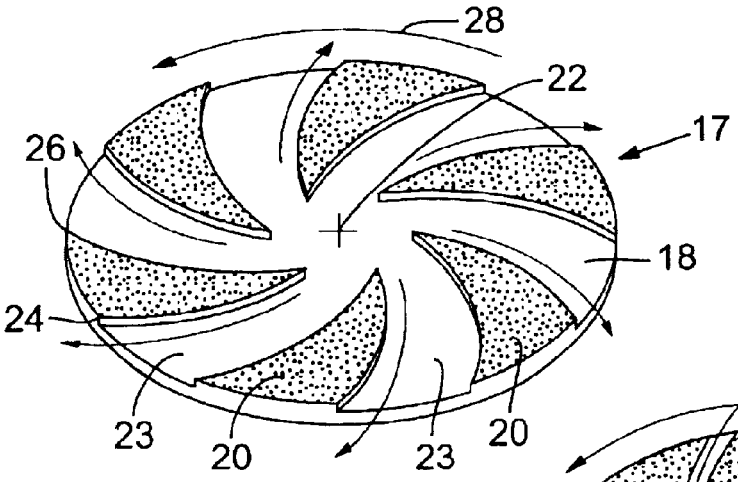
FIG. 2
FIG. 4
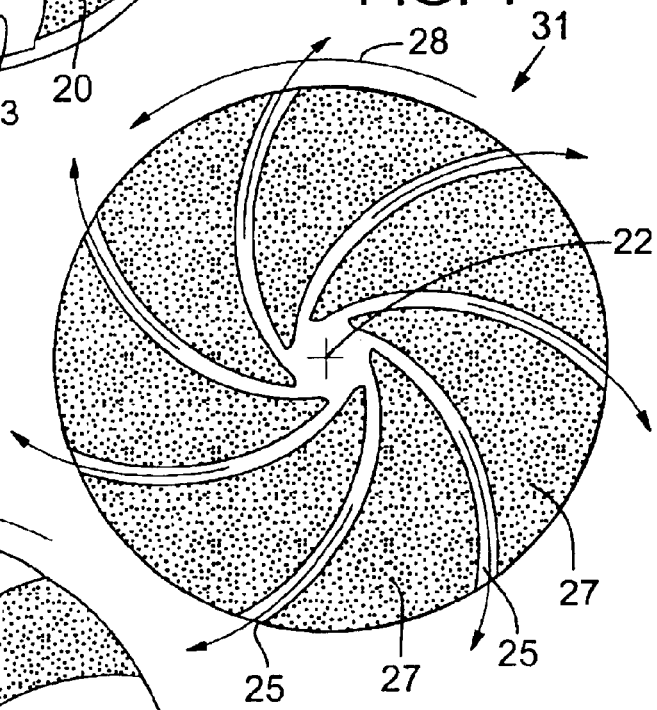
FIG. 5
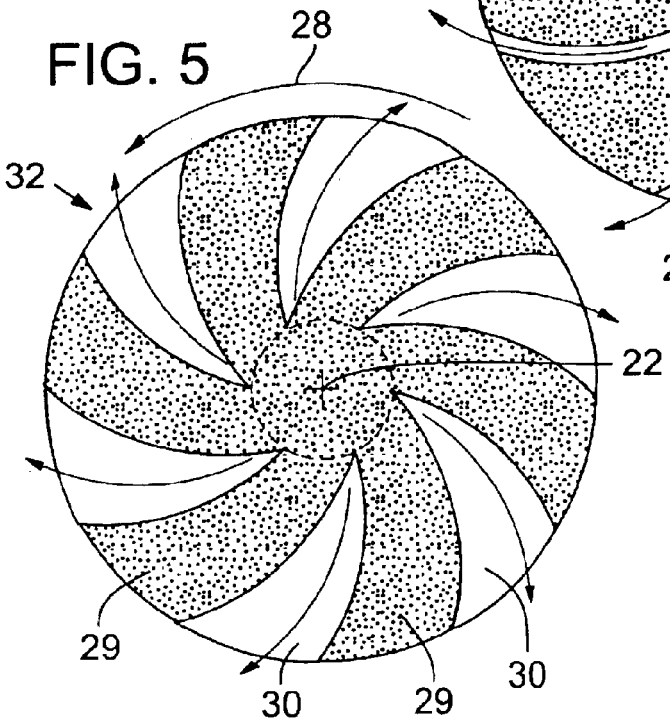

POLISHING PAD CONDITIONING METHOD AND APPARATUS

FIELD OF THE INVENTION

The present invention relates to an apparatus and method of using a substrate polishing pad conditioning apparatus and, more particularly, to a conditioning plate that has recessed portions for managing polishing agents and unwanted debris.

BACKGROUND OF INVENTION

During the microelectronic device fabrication process, multiple integrated circuits are formed upon the surface of substrate. Examples of substrates include, but are not limited to silicon wafers, gallium arsenide wafers and the like. Each integrated circuit consists of micro electronic devices electrically interconnected with conductive traces known as interconnects. Interconnects are patterned from conductive layers formed on the surface of the substrate. The ability to form stacked layers of interconnects has allowed for more complex micro circuits to be implemented in and on relatively small surface areas of the substrate. With the number of micro circuits increasing and becoming more complex, the number of layers of a substrate are increasing. Accordingly, planarity of the substrate surface becomes a critical dimension, and is now found to be important to maximizing circuit performance.

Chemical mechanical polishing (CMP) is a known method of planarizing the surface of a layer of a substrate. CMP combines chemical etching and mechanical abrasion to remove roughness on the surface of the substrate. FIG. 1 is an example of a top view of a known CMP process. During the CMP process, the substrate 10, being attached to a head 12, is inverted such that the integrated circuit-embodied surface opposably faces a polishing pad 14. Polishing pad 14 is saturated with a slurry containing abrasive particles and a mild chemical etchant that softens or catalyzes the exposed surface being planarized. The polishing pad 14 is fixedly attached to a turntable or platen (not shown). The substrate 10 is polished by placing the substrate 10 into contact with the polishing pad 14 while the polishing pad 14 is rotated on the platen. The surface roughness of the integrated circuit-embedded embedded surface of the substrate 10 is removed by the combined action of chemical softening of the exposed surface material and physical abrasion brought about by relative movement between the polishing pad 14, the slurry and the substrate 10.

As portions of the substrate 10 are removed by the polishing pad 14, a combination of slurry and debris tends to clog the surface of the polishing pad 14, such that over time, the polishing pad 14 becomes less effective. The surface of polishing pad 14 is cleaned by conditioning disc 16, which has an abrasive surface that engages the polishing pad surface. Known conditioning discs are typically made of stainless steel and have an abrasive surface, such as coatings like diamond grit or with surface marks. The abrasive surface of conditioning disc 16, however, tends to clog with slurry and debris, thereby rendering less and less effective over time. The spent conditioning discs are removed from the CMP machine and either treated to refresh the conditioning surface or discarded. This process is time consuming, expensive and complicates achieving accurate planarity due to uneven declining effectiveness over the life of the conditioning disc.

Accordingly, new configurations and methods are needed for providing a conditioning disc that will resist clogging, and which provides for minimal downtime and replacement, thereby reducing manufacturing costs.

BRIEF DESCRIPTION OF DRAWINGS

FIG. 2 is a perspective view of a conditioning apparatus in accordance with an embodiment of the invention;

FIG. 4 is a top view of another embodiment of the conditioning apparatus in accordance with the invention; and FIG. 5 is a top view of another embodiment of the conditioning apparatus in accordance with the invention.

DESCRIPTION

Figure 1:
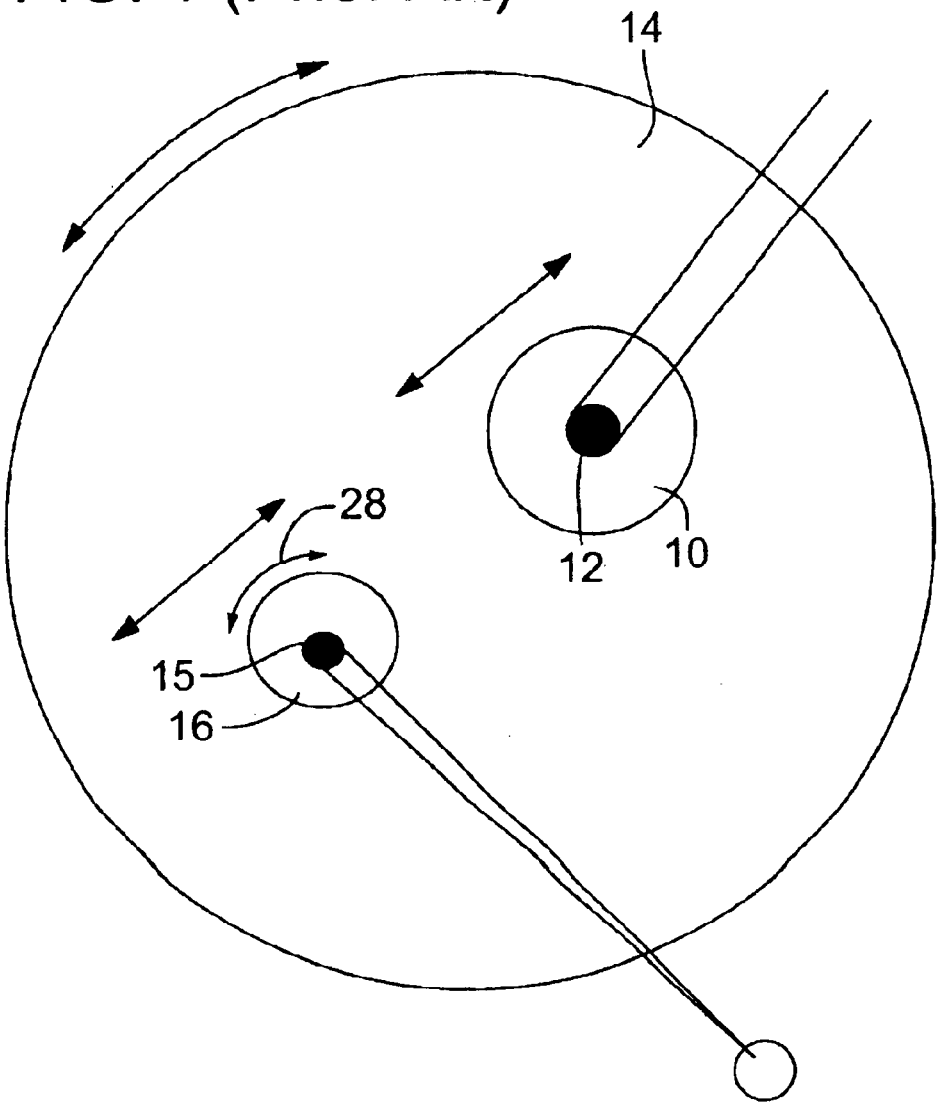
FIG. 1 (Prior Art)
FIG. 1 is a top view of a CMP process machine.

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

FIG. 2 is a perspective view of an embodiment in accordance with the present invention, showing a conditioning plate 17 comprising a plurality of recessed portions or channels 18 that define a plurality of adjacent conditioning surfaces 20. Though shown as circular in the illustrated embodiment, conditioning plate 17 can be oblong, polygonal or similarly shaped. The conditioning plate 17 revolves in the process of conditioning the polishing pad (shown as 19 in FIG. 3) by managing the slurry and debris accumulating thereon. Debris and slurry are transition from the conditioning surfaces 20 into the channels 18. Channels 18 then can move debris and slurry toward the perimeter 23 or toward the center 22, depending on the rotation of the conditioning plate 17. Conditioning surfaces 20 are thereby continuously cleared of slurry and debris, thus prolonging the effectiveness of the conditioning surfaces 20.

The conditioning surfaces 20 and the channels 18 can taper from the perimeter of the conditioning plate 17 toward the center 22 and may be generally swept back in a counter rotational direction. Each conditioning surface 20 can have a generally convex leading edge 24 and concave trailing edge 26. The conditioning plate 17 can be rotated as indicated by rotational arrow 28, such that the slurry and debris within the channels 18 is urged toward the perimeter 23 of the conditioning plate 17, moving the material away from the conditioning surface 20 of the conditioning plate 17 and from the polishing surface of the polishing pad (shown as 19 in FIG. 3). Conditioning plates can be made of stainless steel, or any other metal allow or composite material, including but not limited to plastic, carbon bases, or fiber reinforced. The Conditioning surfaces can be abrasive through coatings, like diamond grit, or with surface marks.

The leading edge 24 and trailing edge 26 can be curved in varying degrees, as well as being straight, depending on predetermined factors such as the rotational speed of the conditioning plate 17 and the polishing pad 14 (shown as 19 in FIG. 3), slurry viscosity, and the expected amount of debris removal. Finally, the leading edge and trailing edge, though shown to be substantially vertical, may be tapered to allow material to gradually transition from the conditioning surface 20 to channel 18.

The rotation of conditioning plate 17 can be reversed, opposite of that shown by rotational arrow 28. Reverse rotation of the conditioning plate 17 urges the slurry toward the center 22 of conditioning plate 17. Such a rotation may be advantageous for low viscosity slurries used for certain polishing applications. In the reverse direction, the channels 18 tend to retain the slurry and debris on the conditioning surface 20 of the conditioning plate 17.

Figure 3:
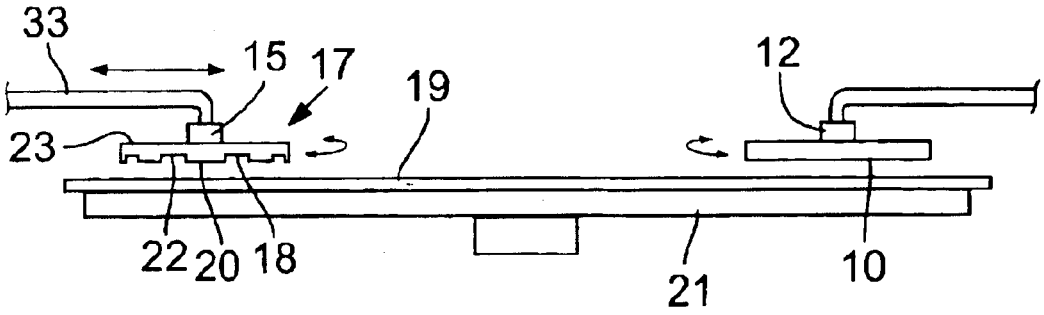
FIG. 3 is a side view of a CMP process machine using a conditioning apparatus in accordance with an embodiment of the invention.

FIG. 3 is a side view of a CMP process machine with the conditioning plate 17. Substrate 10, secured to head 12, opposably faces polishing pad 19 secured to rotatable platen 21. Conditioning plate 17, secured to head 15 and linkage 33, opposably faces polishing pad 19. Depending on the configuration of channels 18, conditioning plate can rotated in a direction that urges the slurry and debris toward perimeter 23, or in the opposite direction to urge the slurry and debris toward the center 22. The conditioning surfaces 20 keep the surface of polishing pad 19 from slurry and debris buildup. Linkage 33 can also move head 15 and conditioning disk 17 in a linear direction to condition the entire surface of the polishing pad 19.

FIG. 4 is a top view of another embodiment of the conditioning plate 31 in accordance with the present invention. The ratio between the width of the channels 25 and the width of the conditioning surfaces 27 is considerably smaller than that shown in FIG. 2. The conditioning plate 31 comprises channels 25, the width and depth of which are determined for a particular purpose that depend on a number of factors, including, but not limited to, the slurry consistency and viscosity, the size and amount of debris to be removed from the substrate and the rotational speed of both conditioning plate 19 and the polishing pad 19 (shown in FIG. 3).

FIG. 4 is a top view of a conditioning plate 32 in accordance with another embodiment of the present invention. The conditioning plate 21 comprises a center 22 that is part of the conditioning surface 29, and the channels 30 do not traverse the entire diameter of the conditioning plate 32.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A polishing pad conditioning apparatus, comprising:

a substantially flat, rigid, and rotatable plate having a first conditioning side, a second side, a perimeter and a center, the conditioning side comprising a plurality of channels defining a plurality of conditioning surfaces that are substantially covered with a conditioning material, each channel defining a leading edge of one conditioning surface and a trailing edge of a different conditioning surface, the conditioning surfaces adapted to condition a surface of a polishing pad, and each conditioning surface extending in a substantially continuous manner from the perimeter toward the center, the channels adapted to move debris and slurry based on the rotation of the substantially flat rotatable plate.

2. The apparatus of claim 1, wherein at least one of the plurality of conditioning surfaces tapers in width from the perimeter toward the center.

3. The apparatus of claim 1, wherein at least one of the plurality of channels tapers in width from the perimeter toward the center.

4. The apparatus of claim 1, wherein at least one of the leading edge and trailing edge of one of the conditioning surfaces is curved from the perimeter toward the center.

5. The apparatus of claim 1, wherein the leading edge and trailing edge of at least one of the conditioning surfaces are sloped away from the conditioning surface.

6. The apparatus of claim 1, wherein the plurality of channels extend to the center.

7. The apparatus of claim 1, wherein the substantially flat, rigid, rotatable plate is formed with stainless steel.

8. The apparatus of claim 1, wherein at least one of the plurality of conditioning surfaces contains diamond chips as the conditioning material.

9. A substrate polishing apparatus, comprising:

a rotatable substrate containment head, the substrate containment head adapted to retain a substrate for polishing;

a rotatable platen positioned to oppose the substrate containment head;

a polishing pad coupled to the platen; and a polishing pad conditioning plate comprising a substantially flat, rigid, and rotatable plate having a first conditioning side, a second side, a perimeter and a center, the conditioning side comprising a plurality of channels defining a plurality of conditioning surfaces that are substantially covered with a conditioning material, each channel defining a leading edge of one conditioning surface and a trailing edge of a different conditioning surface, the conditioning surfaces adapted to condition the surface of a polishing pad, and each conditioning surface extending in a substantially continuous manner from the perimeter toward the center, the channels adapted to move debris and slurry based on the rotation of the substantially flat rotatable plate.

10. The apparatus of claim 9, wherein at least one of the plurality of conditioning surfaces tapers in width from the perimeter toward the center.

11. The apparatus of claim 9, wherein at least one of the plurality of channels tapers in width from the perimeter toward the center.

12. The apparatus of claim 9, wherein at least one of the leading edge and trailing edges of at lest one of the conditioning surfaces are curved from the perimeter toward the center.

13. The apparatus of claim 9, wherein the leading edge and trailing edge of at least one of the conditioning surface are sloped away from the conditioning surface.

14. The apparatus of claim 9, wherein the plurality of channels extend to the center.

15. The apparatus of claim 9, wherein the substantially flat, rigid, rotatable plate is formed with stainless steel.

16. The apparatus of claim 9, wherein at least one of the plurality of conditioning surfaces contain diamond chips as the conditioning material.

17. A method of conditioning a substrate polishing pad, comprising:

providing a rotatable platen capable of rotating in a first direction and a second direction;

providing a substrate polishing pad having a first side adapted to polish substrates and a second side adapted to engage the rotatable platen;

providing a polishing pad conditioning pate comprising a substantially flat, rigid, and rotatable plate having a first conditioning side, a second side, a perimeter and a center, the conditioning side comprising a plurality of channels defining a plurality of conditioning surfaces that are substantially covered with a conditioning material, each channel defining a leading edge of one conditioning surface and a trailing edge of a different conditioning surface, the conditioning surfaces being adapted to condition the surface of a polishing pad, each conditioning surface extending in a substantially continuous manner from the perimeter toward the center, the channels having been adapted to move debris and slurry based on the rotation of the substantially flat rotatable plate, and the second side having been adapted to couple with a polishing machine;

placing the substrate polishing pad on the rotatable platen with the first side facing outward;

rotating the platen and polishing pad;

positioning the substantially flat rotatable plate such that the first side contacts the polishing surface of the polishing pad; and rotating the substantially flat rotatable plate.

18. The method of claim 17, further comprising:

rotating the platen and polishing pad in the first direction; and rotating the substantially flat rotatable plate in the second direction such that material removed from the polishing surface is urged toward the perimeter of the substantially flat rotatable plate.

19. The method of claim 17, further comprising:

rotating the platen and polishing pad in the first direction; and rotating the substantially flat rotatable plate in the first direction such that material removed from the polishing surface is urged toward the center of the substantially flat rotatable plate.

20. The method of claim 17, further comprising linearly moving the substantially flat rotatable plate across the polishing pad.

* * * * *

UNITED STATES PATENT AND TRADEMARK OFFICE

CERTIFICATE OF CORRECTION

PATENT NO. : 6,949,012 B2
APPLICATION NO. : 10/316533
DATED : September 27, 2005
INVENTOR(S) : Herb Barnett III It is certified that error appears in the above-identified patent and that said Letters Patent is hereby corrected as shown below:

Column 3
Line 25, "...conditioning disk 17..." should read --...conditioning plate 17...--.
Line 37, "...conditioning plate 19..." should read --...conditioning plate 17...--.
Line 41, "...conditioning plate 21..." should read --...conditioning plate 32...--.

Column 4
Line 16, "...one of...are..." should read --...one of...is...--.
Line 53, "...at lest one..." should read --...at least one...--.
Lines 53-54, "...one of...are..." should read --...one of...is...--.
Line 57, "...conditioning surface..." should read --...conditioning surfaces...--.
Lines 57-58, "...one of...are..." should read --...one of...is...--.
Lines 64-64, "...one of...contain..." should read --...one of...contains...--.

Column 5
Line 6, "...conditioning pate..." should read --...conditioning plate...--.

Signed and Sealed this

Sixteenth Day of January, 2007

JON W. DUDAS
*Director of the United States Patent and Trademark Office*